US011714372B2

(12) United States Patent
Tanaka et al.

(10) Patent No.: US 11,714,372 B2
(45) Date of Patent: Aug. 1, 2023

(54) IMAGE FORMING APPARATUS

(71) Applicant: CANON KABUSHIKI KAISHA, Tokyo (JP)

(72) Inventors: Takatoshi Tanaka, Shizuoka (JP); Yoshihiko Tanaka, Shizuoka (JP); Naoki Matsushita, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/674,684

(22) Filed: Feb. 17, 2022

(65) Prior Publication Data

US 2022/0276599 A1 Sep. 1, 2022

(30) Foreign Application Priority Data

Feb. 26, 2021 (JP) ..... 2021-030077

(51) Int. Cl.
*G03G 15/00* (2006.01)
*G03G 15/04* (2006.01)

(52) U.S. Cl.
CPC ..... *G03G 15/55* (2013.01); *G03G 15/04036* (2013.01)

(58) Field of Classification Search
CPC ..... G03G 15/55; G03G 15/553; B41J 2/435–473
See application file for complete search history.

(56) References Cited

U.S. PATENT DOCUMENTS 5,732,308 A * 3/1998 Miura ..... G03G 15/04 399/220
2007/0086817 A1* 4/2007 Kato ..... G03G 15/6564 399/388
2011/0026955 A1* 2/2011 Takahashi ..... G03G 15/1675 399/48
2016/0349659 A1* 12/2016 Shoji ..... G03G 15/0409
2018/0059571 A1* 3/2018 Eguchi ..... G06K 15/1219
2018/0284680 A1* 10/2018 Asaka ..... G03G 15/04072
2019/0308420 A1* 10/2019 Yamamoto ..... B41J 2/471
2020/0021707 A1* 1/2020 Kojima ..... G03G 15/043

FOREIGN PATENT DOCUMENTS

JP 2001268975 A 9/2001
JP 2003259677 A 9/2003
JP 2005059449 A 3/2005
JP 2014071338 A 4/2014

* cited by examiner

*Primary Examiner* — Carla J Therrien
(74) *Attorney, Agent, or Firm* — Canon U.S.A., Inc. IP Division

(57) ABSTRACT

In an image forming apparatus, a lifetime detection unit acquires an activation time threshold using a threshold stored in an activation time storage unit and an environmental temperature detected by a temperature detection unit, and, in a case where activation time acquired by an activation time acquisition unit is shorter than the activation time threshold, makes a notification of at least one of a lifetime or replacement of a deflection unit or an optical scanning unit.

12 Claims, 13 Drawing Sheets

IMAGE FORMING APPARATUS

BACKGROUND

Field

The present disclosure relates to an image forming apparatus that scans a photosensitive member with a laser beam according to image information, such as a laser beam printer and a copy machine.

Description of the Related Art

An optical scanning unit mounted on an image forming apparatus, such as a laser printer, includes a deflection unit having a rotating mirror that reflects a laser beam. Examples of a system of a bearing for a motor that rotates the rotating mirror include a liquid bearing system. Over time, the motor of the liquid bearing system degrades due to reduction of oil with long-term usage, abrasion by repeated activation and stop, and the like, and eventually ceases to rotate. Japanese Patent Application Laid-Open No. 2001-268975 discusses a technique of detecting abnormality of a motor, and abnormality of a motor due to abnormality of a control circuit or the like.

In a case where the motor ceases to rotate normally, it is necessary to replace the deflection unit or the optical scanning unit.

The above-mentioned conventional example, however, relates to the technique of converting the number of rotations of the rotating mirror to a voltage, monitoring whether its voltage value is within a predetermined range, and thereby detecting abnormality in rotation of a drive substrate. With such a detection method, it is necessary to set a wide range of voltage values (the numbers of rotations) in consideration of variable factors such as an installation environment of the drive substrate and usage conditions, and it can be difficult to make a notification of an accurate replacement timing.

Another possible method is to preliminarily ascertain a period of time during which the deflection unit is usable and replace the deflection unit when the period of time elapses.

However, there are individual differences in lifetime of the deflection unit, and timings appropriate for replacement are different depending on past usage conditions of a printer. For this reason, if replacement is performed at a timing when a predetermined period of time elapses, there is a possibility that even a usable deflection unit is replaced.

SUMMARY

Various embodiments of the present disclosure provide an image forming apparatus that makes an appropriate notification of a time for replacing a deflection unit or an optical scanning unit.

According to various embodiments of the present disclosure, an image forming apparatus configured to form an image on a recording material includes a photosensitive member and an optical scanning unit configured to scan the photosensitive member with a laser beam according to image information. The optical scanning unit includes a deflection unit configured to deflect the laser beam, the deflection unit including a rotating mirror configured to reflect the laser beam and a motor configured to rotate the rotating mirror and having a bearing filled with a lubricant. The image forming apparatus further includes a temperature detection unit configured to detect an environmental temperature, an activation time storage unit configured to store a threshold of activation time of the deflection unit, an activation time acquisition unit configured to acquire activation time since the deflection unit starts to be activated until speed of the deflection unit reaches rated rotation speed or a predetermined ratio with respect to the rated rotation speed, and a lifetime detection unit configured to detect a lifetime of the deflection unit or the optical scanning unit. The lifetime detection unit acquires an activation time threshold using the threshold stored in the activation time storage unit and the environmental temperature detected by the temperature detection unit and makes a notification of at least one of the lifetime or replacement of the deflection unit or the optical scanning unit in a case where the activation time acquired by the activation time acquisition unit is shorter than the activation time threshold.

According to other embodiments of the present disclosure, an image forming apparatus configured to form an image on a recording material includes a photosensitive member and an optical scanning unit configured to scan the photosensitive member with a laser beam according to image information. The optical scanning unit includes a deflection unit configured to deflect the laser beam, the deflection unit including a rotating mirror configured to reflect the laser beam and a motor configured to rotate the rotating mirror and having a bearing filled with a lubricant. The image forming apparatus further includes a temperature detection unit configured to detect an environmental temperature, a current value storage unit configured to store a threshold of current flowing through the deflection unit, a current value acquisition unit configured to acquire a value of current supplied to the deflection unit, and a lifetime detection unit configured to detect a lifetime of the deflection unit or the optical scanning unit. The lifetime detection unit acquires a current value threshold using the threshold stored in the current value storage unit and the environmental temperature detected by the temperature detection unit and makes a notification of at least one of the lifetime or replacement of the deflection unit or the optical scanning unit in a case where the value of the current acquired by the current value acquisition unit is lower than the current value threshold.

Further features of the present disclosure will become apparent from the following description of example embodiments with reference to the attached drawings.

DESCRIPTION OF THE EMBODIMENTS

A first example embodiment is described below.

<Image Forming Apparatus>

Figure 13:
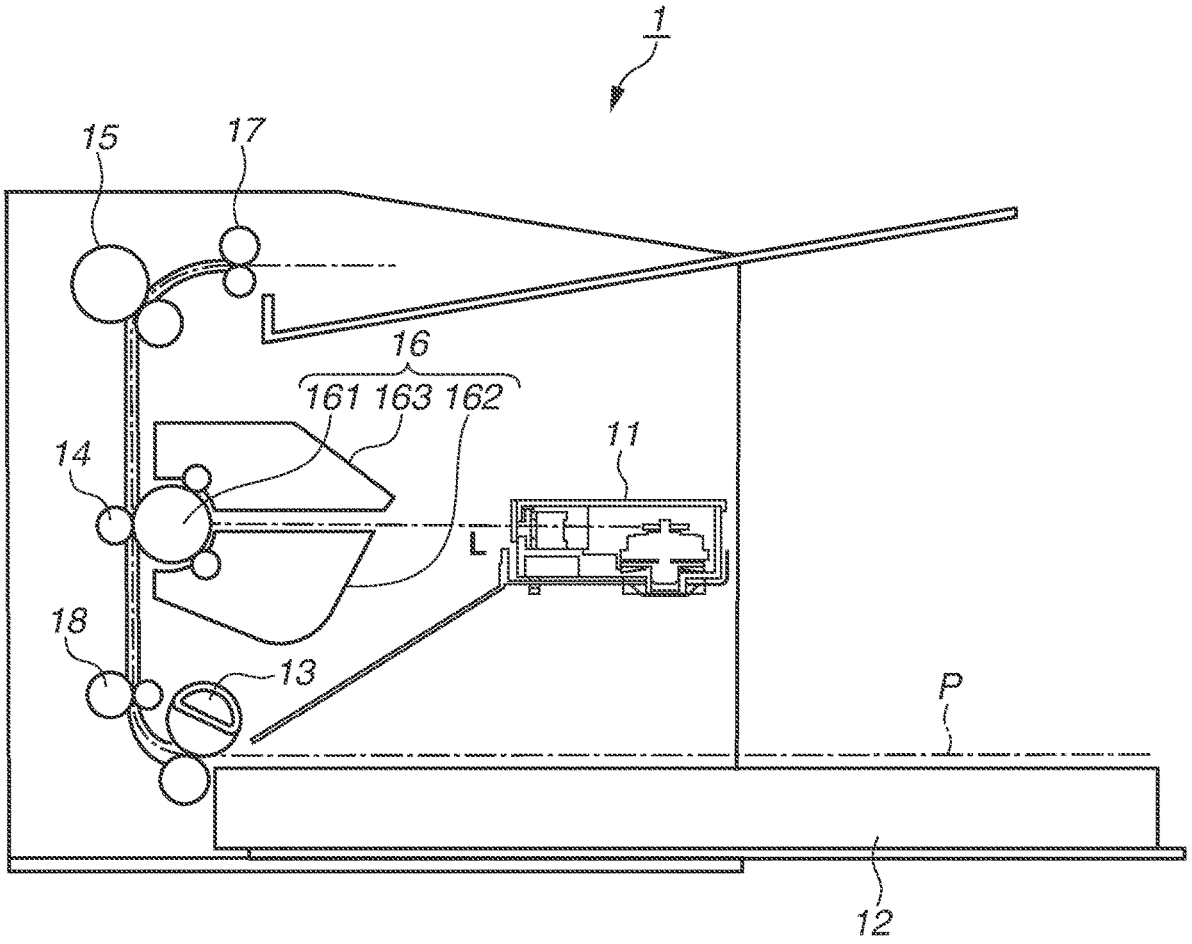
FIG. 13 is a sectional view of an image forming apparatus.

FIG. 13 is a sectional view of an image forming apparatus 1. The image forming apparatus (electrophotographic printer) 1 that forms an image on a recording material P includes a photosensitive member 161 and an optical scanning unit 11 that scans the photosensitive member 161 with a laser beam according to image information. An electrostatic-latent image is formed on the photosensitive member 161, which has been scanned with the laser beam. The electrostatic latent image is developed with toner supplied by a development device arranged in a process cartridge 16, and a toner image is thereby formed on the photosensitive member 161.

On the other hand, the recording material P loaded on a recording material loading plate 12 is fed while being separated one sheet by one sheet by a feed roller 13, and thereafter conveyed further to a downstream side by an intermediate roller 18. A toner image formed on the photosensitive member 161 is transferred, by a transfer roller 14, onto the conveyed recording material P. Remaining toner on the photosensitive member 161 after the toner image has been transferred onto the recording material P is collected by a cleaner 163. The recording material P on which the unfixed toner image is formed is heated by a fixing device 15 that incorporates a heat source, and the toner image is thereby fixed to the recording material P. Thereafter, the recording material P is discharged to an outside of the image forming apparatus 1 by a discharge roller 17.

<Optical Scanning Unit>

Figure 1:
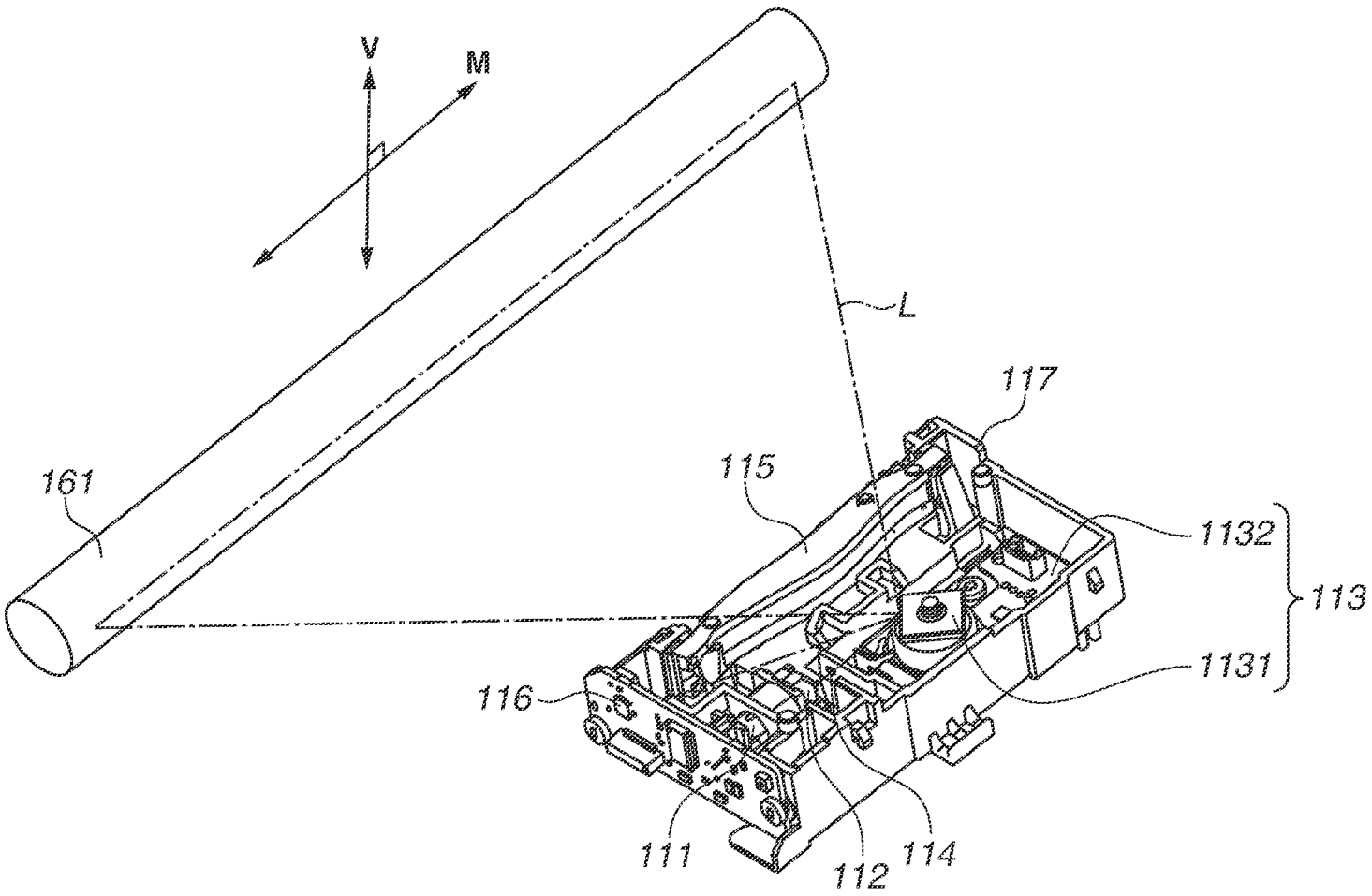
FIG. 1 is a perspective view of an optical scanning unit.

The optical scanning unit 11 is now described with reference to FIG. 1. The optical scanning unit 11 includes a semiconductor laser unit 111 that emits a laser beam L. The optical scanning unit 11 also includes a compound anamorphic collimator lens 112 that is formed by integrating an anamorphic collimator lens and a synchronization signal detection lens (beam detector (BD) lens). The anamorphic collimator lens 112 is formed by integrating a collimator lens and a cylindrical lens. The optical scanning unit 11 further includes an aperture diaphragm 114, a rotating mirror (rotating polygon mirror) 1131, a drive substrate 1132 on which a motor that rotates the rotating mirror is mounted, a synchronization signal detection sensor (BD sensor) 116, a scanning lens 115, and an optical box 117. A deflection unit 113 includes the rotating mirror 1131 and the drive substrate 1132.

The compound anamorphic collimator lens 112 causes the laser beam L emitted from the semiconductor laser unit 111 to become substantially parallel light or converged light in a main scanning direction and to become converged light in a sub scanning direction. Thereafter, the laser beam L passes through the aperture diaphragm 114, and a beam width thereof is controlled. The laser beam L is then formed as an image in a focal line shape that extends long in the main scanning direction on a reflection surface of the rotating mirror 1131. With the rotation of the rotating mirror 1131 having four reflection surfaces, the laser beam L is deflected, and then the laser beam L is incident on the BD lens of the compound anamorphic collimator lens 112. The laser beam L that has passed through the BD lens is incident on the synchronization signal detection sensor 116. At this time, a synchronization signal (BD signal) is detected by the synchronization signal detection sensor 116. Assume that a timing of the detection is a synchronization detection timing at a writing start position in the main scanning direction.

The laser beam L is incident on the scanning lens 115. The scanning lens 115 is designed to collect the laser beam L so as to form a spot on the photosensitive member 161 and maintain equal scanning speed of the spot. The scanning lens 115 is formed as an aspheric surface lens to obtain such characteristics of the scanning lens 115. The laser beam L that has passed through the scanning lens 115 is emitted from an exit aperture of the optical box 117, scans the photosensitive member 161, and formed as an image on the photosensitive member 161. With the rotation of the rotating mirror 1131, the laser beam L is deflected, and main scanning on the photosensitive member 161 with the laser beam L (scanning in a main scanning direction M) is performed. In addition, by rotary drive of the photosensitive member 161 around an axis line of a cylinder of the photosensitive member 161, sub scanning (scanning in a sub scanning direction V) is performed.

In this manner, an electrostatic-latent image is formed on the surface of the photosensitive member 161.

<Deflection Unit>

The deflection unit 113 is now described with reference to FIGS. 1 and 2. A motor 300 composed of a rotor 301 and a stator 302 is mounted on the drive substrate 1132 of the deflection unit 113. The stator 302 is fixed to the optical box 117, and the rotor 301 is rotated with respect to the stator 302 by an electromagnetic force.

Figure 2:
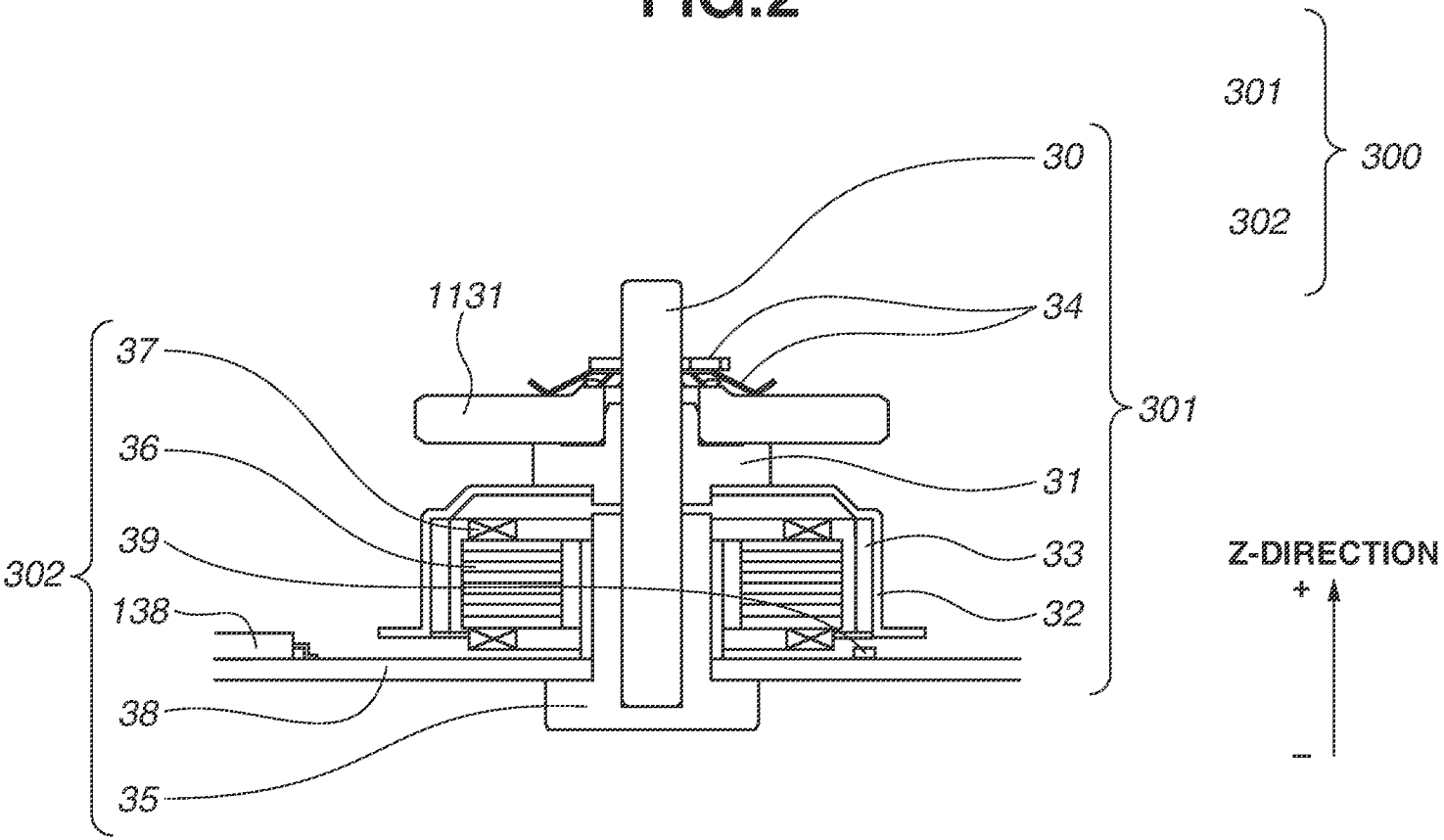
FIG. 2 is a partial sectional view of a deflection unit.

FIG. 2 is a partial sectional view of the deflection unit 113. The rotor 301 includes a rotating shaft 30, a rotor boss 31, a rotor frame 32, and a rotor magnet 33. The rotating mirror 1131 is attached to the rotor 301 by a fastening device 34. The stator 302 includes a circuit substrate 38 arranged on the drive substrate 1132, a Hall element (magnetic sensor) 39 soldered onto the circuit substrate 38, a bearing 35, a stator core 36, and a stator coil 37. An element 138 for preventing damage due to overcurrent through a circuit is also arranged on the circuit substrate 38.

A material of the rotating mirror 1131 is metal such as aluminum or plastic.

In the configuration described above, when a current is supplied to the stator coil 37, an electromagnetic force is generated between the stator coil 37 and the rotor magnet 33, and the rotor 301 rotates together with the rotating shaft 30 that is rotatably supported by the bearing 35. The Hall element 39 is a magnetic sensor for determining a timing (rectification timing) to make a current flow into the stator coil 37, and is disposed below the rotor magnet 33. The Hall element 39 detects a magnetic pole (north (N) or south (S)) of the rotor magnet 33. A space between the rotating shaft 30 and the bearing 35 is filled with a lubricant. With repeated operations of the deflection unit 113, the lubricant evaporates or scatters as oil mist, and then decreases.

<Deflection Unit Lifetime Detection System>

Figure 3:
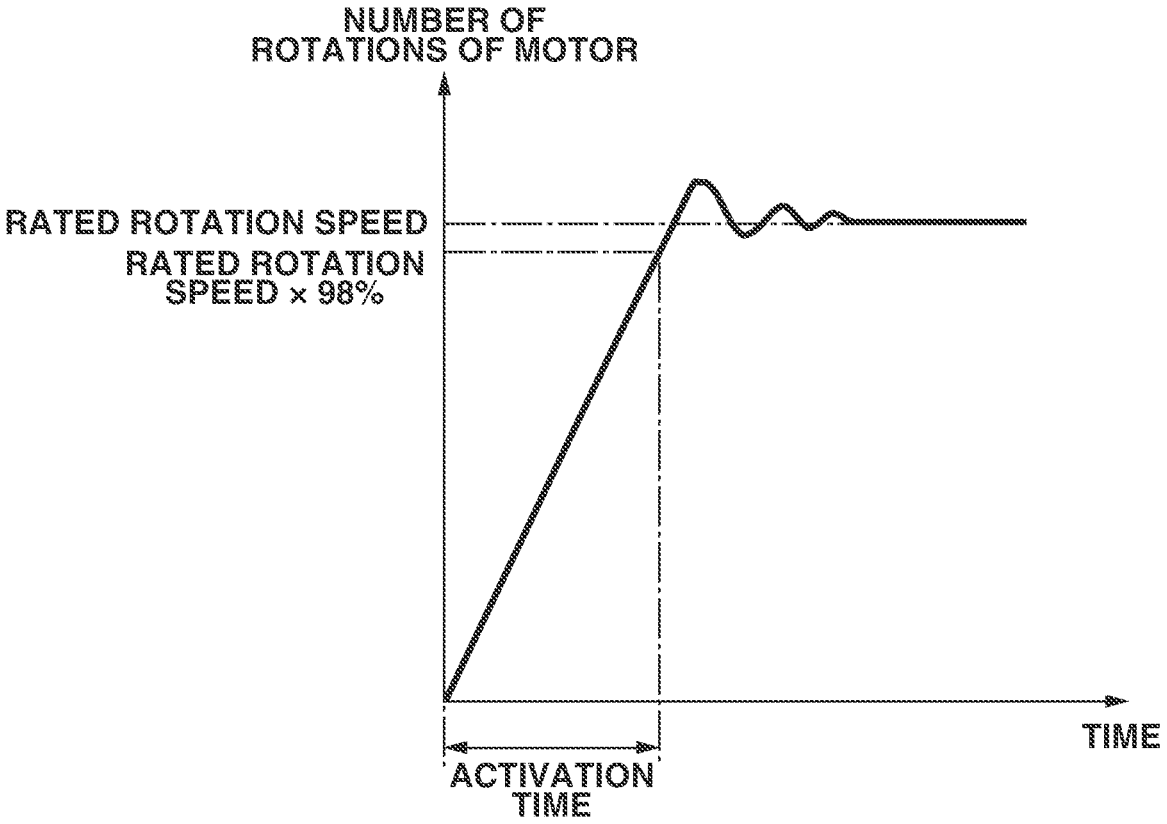
FIG. 3 is a conceptual diagram illustrating activation time.

A description is now given of a deflection unit lifetime detection system using a value change in activation time of the deflection unit 113. FIG. 3 is a diagram illustrating a change in the number of rotations of the deflection unit 113 when the deflection unit 113 is activated. The activation time used in the present detection system is time since the deflection unit 113 starts to be activated until the speed of the deflection unit 113 reaches rated rotation speed or a predetermined ratio with respect to the rated rotation speed. The predetermined ratio is, for example, about 98% to 100%. The speed of the deflection unit 113 converges to the rated rotation speed after elapse of the activation time under acceleration/deceleration control. The deflection unit 113 repeats, when activated until its speed is near the rated rotation speed, acceleration and deceleration until its speed converges to the rated rotation speed.

Figure 4:
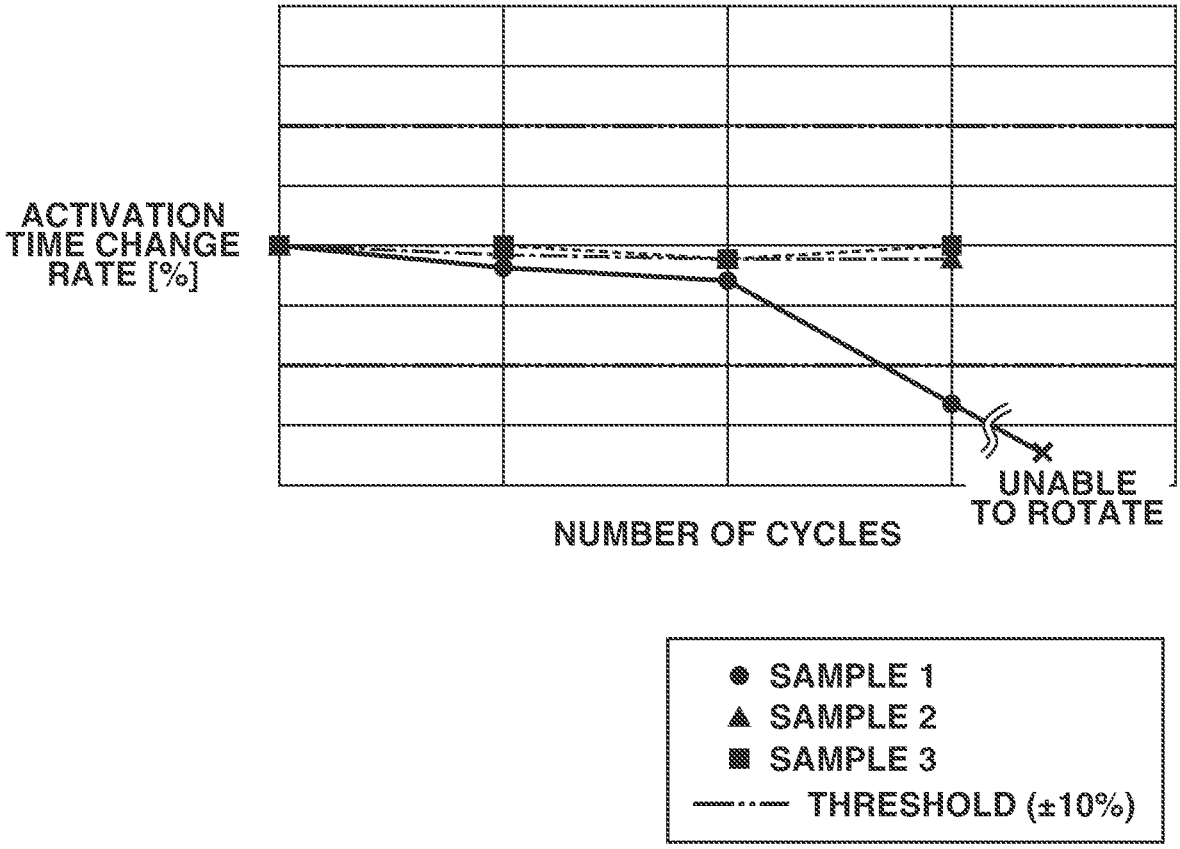
FIG. 4 is a diagram illustrating a transition of an activation time change rate.

FIG. 4 is a diagram graphically illustrating the number of cycles of repetition of activation/stop of the deflection unit 113 and a value change in activation time. An activation time change rate corresponds to a ratio between activation time when the deflection unit 113 is in a new state and activation time after activation/stop is repeated in a predetermined cycle. By repeating the activation/stop of the deflection unit 113, reduction of the lubricant in the bearing 35 illustrated in FIG. 2 decreases resistance of the bearing 35, and thereby shortens the activation time. It is a timing to replace the deflection unit 113 when a change in the activation time exceeds a predetermined threshold. As can be seen from FIG. 4, the activation time change rate is different for each sample of the deflection unit 113. The activation time change rate of a sample 1 becomes smaller than the threshold as the number of cycles increases, and the sample 1 has reached time for replacement. On the other hand, the activation time change rates of samples 2 and 3 remain within the threshold at a timing when the activation time change rate of the sample 1 becomes smaller than the threshold, and the samples 2 and 3 have not yet reached time for replacement. In such a case, the sample 1 is only required to be replaced, the deflection units 113 of the samples 2 and 3 remain to be usable. While the deflection unit 113 is a target of replacement in the present example embodiment, the optical scanning unit 11 that incorporates the deflection unit 113 can be replaced.

Figure 5:
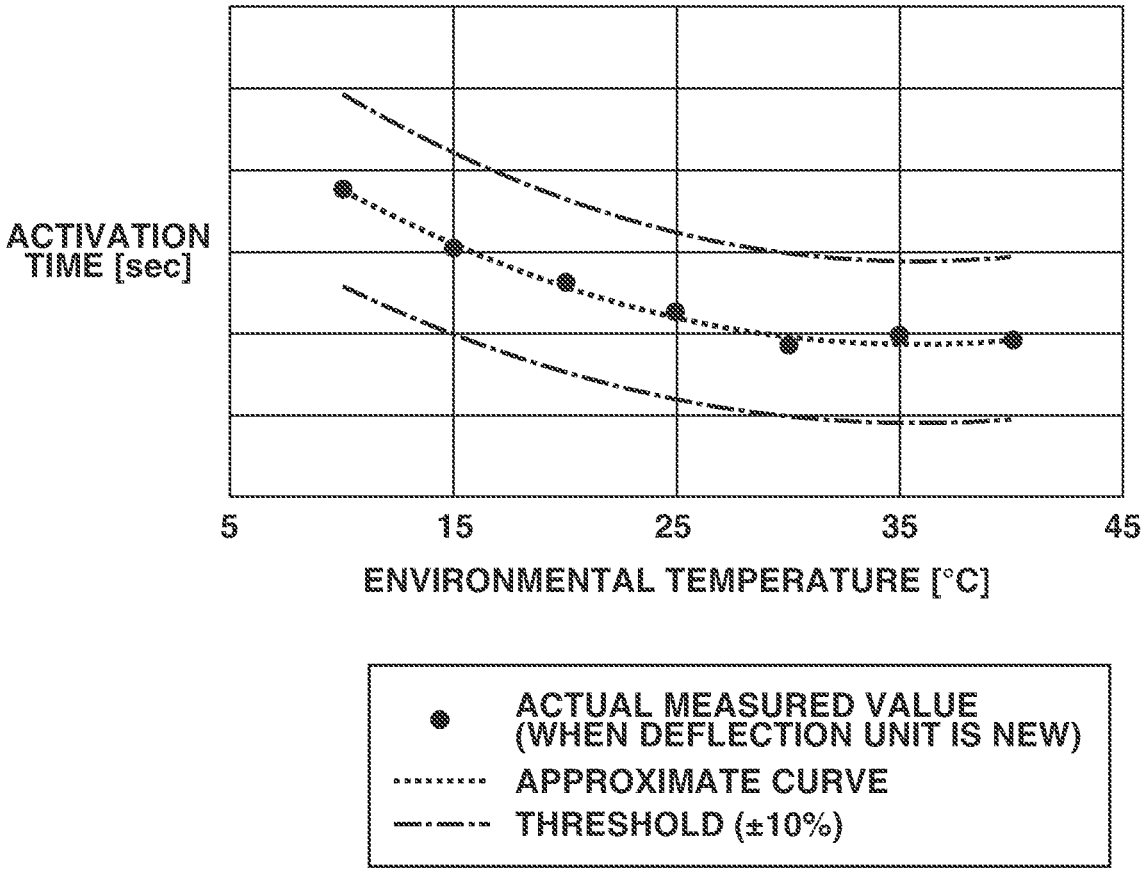
FIG. 5 is a diagram illustrating a change in activation time corresponding to a change in environmental temperature.

FIG. 5 is a diagram illustrating a relationship between a temperature in an environment in which the image forming apparatus 1 is installed (environmental temperature) and the activation time of the deflection unit 113. Since the viscosity of the lubricant filling the space between the bearing 35 and the rotating shaft 30 changes depending on a temperature, rotational resistance of the rotating shaft 30 also changes, and then the activation time changes. As the temperature becomes higher, the viscosity of the lubricant decreases, the rotational resistance becomes lower, and the activation time becomes shorter. For this reason, to detect time for replacement accurately, it is desirable to detect an environmental temperature in a space in which the deflection unit 113 is installed and to set an activation time threshold on a temperature-by-temperature basis. A temperature adopted as the environmental temperature can be a temperature within the image forming apparatus 1, or a temperature outside the image forming apparatus 1.

A method of acquiring the activation time threshold on the temperature-by-temperature basis is now described. In a step of manufacturing the image forming apparatus 1, a change in activation time with respect to a change in environmental temperature is actually measured for a plurality of deflection units 113, and an approximate expression for a relationship between the environmental temperature and the activation time is obtained. A threshold curve is acquired from the approximate expression. For example, in a case of using a quadratic polynomial approximation, the following expressions hold.

$$T=at^2+bt+c \quad \text{(Expression 1)}$$

$$Tc=(1\pm\alpha)T \quad \text{(Expression 2)}$$

In the expressions, T is the activation time, Tc is the activation time threshold, t is the environmental temperature, a, b, and c are coefficients, and α is a threshold coefficient.

In a case where individual differences in activation time of the plurality of deflection units 113 are large, the activation time of each deflection unit 113 is measured in a step of manufacturing the optical scanning unit 11 and a correction value can be added to the threshold curve.

$$T'=T+c' \quad \text{(Expression 3)}$$

In this expression, c' is the correction value.

The activation time threshold at each environmental temperature can be obtained from the approximate expression obtained as described above.

In the deflection unit 113 according to the present example embodiment, the activation time is reduced by 15% or more as compared to that when the deflection unit 113 is new due to reduction of the lubricant, the bearing 35 is abraded by friction between the rotating shaft 30 and the bearing 35, and abrasion powder is accumulated in the bearing 35. Then the loss of the shaft increases, and eventually, there is an increased risk that the rotating shaft 30 ceases to rotate. For this reason, it is desirable to set such a threshold so as to infallibly make a notification of replacement of the deflection unit 113 at a timing when the activation time becomes shorter by 15% or more as compared to that when the deflection unit 113 is new. It is desirable to set the activation time threshold to be shorter by 10 to 20% than the activation time in a case where the deflection unit 113 is new.

Figure 6:
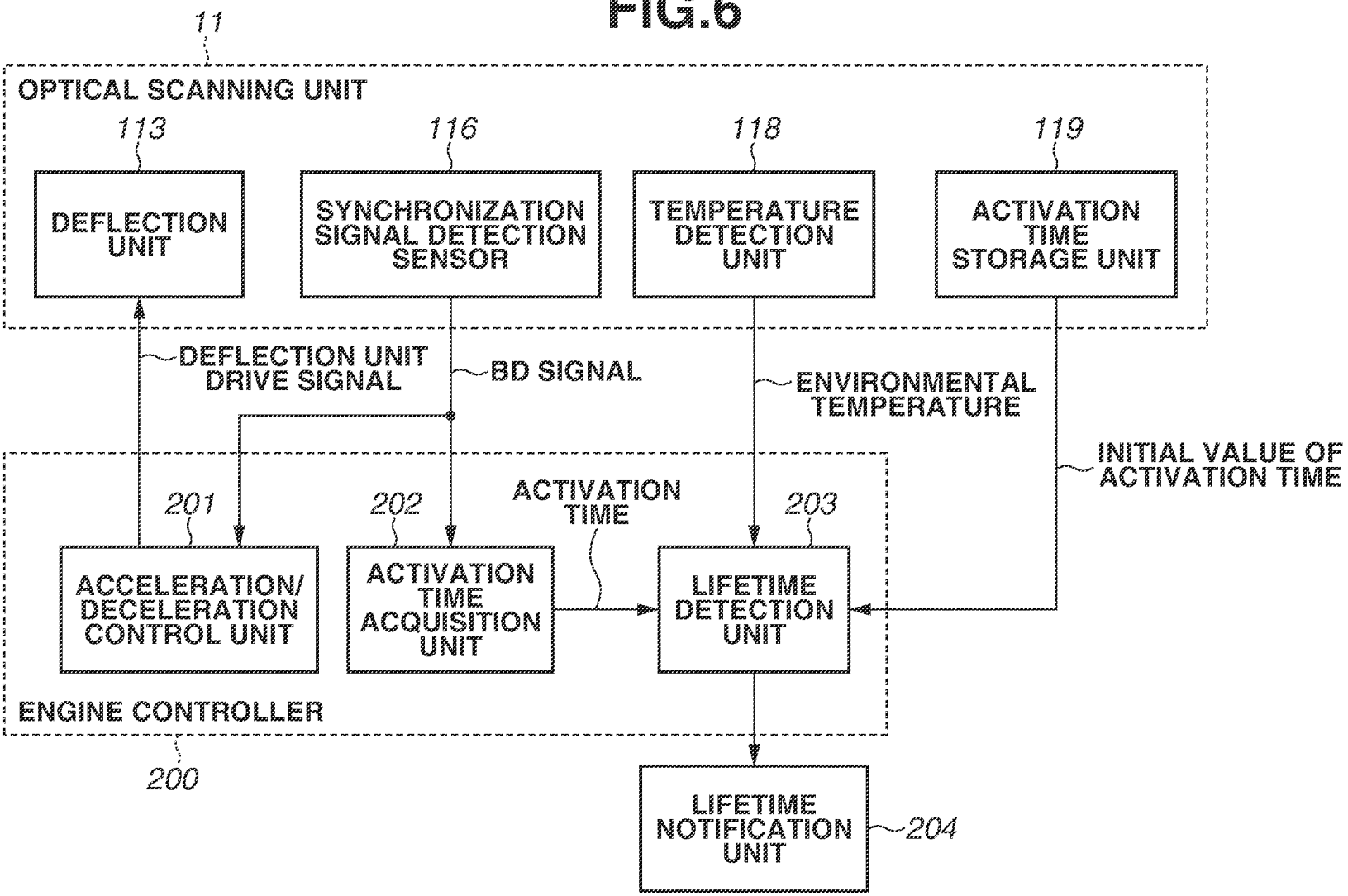
FIG. 6 is a block diagram illustrating a lifetime detection/notification system according to a first example embodiment.

FIG. 6 is a block diagram illustrating a lifetime detection/notification system according to the present example embodiment. An engine controller 200 controls operations of the image forming apparatus 1. An acceleration/deceleration control unit 201 included in the engine controller 200 controls drive of the deflection unit 113. Specifically, the acceleration/deceleration control unit 201 transmits a deflection unit drive signal to the deflection unit 113 using a signal from the synchronization signal detection sensor 116 illustrated in FIG. 1 so that the rotating mirror 1131 rotates at the rated rotation speed with a high accuracy. Further, the engine controller 200 includes an activation time acquisition unit 202. The activation time acquisition unit 202 acquires the activation time using the deflection unit drive signal and a BD signal.

The optical scanning unit 11 includes an activation time storage unit 119. In the step of manufacturing the optical scanning unit 11, the activation time threshold is stored in the activation time storage unit 119.

The optical scanning unit 11 includes a temperature detection unit 118. The temperature detection unit 118 measures an environmental temperature. The temperature detection unit 118 is desirably installed near the deflection unit 113, and can be arranged, for example, on the drive substrate 1132.

A relational expression between the activation time threshold and the environmental temperature is programmed into a lifetime detection unit 203, and the lifetime detection unit 203 acquires a threshold at each environmental temperature. The lifetime detection unit 203 detects whether the deflection unit 113 has reached its lifetime using the activation time acquired by the activation time acquisition unit 202, the activation time threshold stored in the activation time storage unit 119 in the step of manufacturing the optical scanning unit 11, and the environmental temperature detected by the temperature detection unit 118. Specifically, the lifetime detection unit 203 acquires the activation time threshold using the threshold stored in the activation time storage unit 119 and the environmental temperature detected by the temperature detection unit 118. In a case where the activation time acquired by the activation time acquisition unit 202 is shorter than the activation time threshold, the lifetime detection unit 203 makes a notification of at least one of lifetime or replacement of the deflection unit 113 or the optical scanning unit 11. In a case where the activation time is shorter than the activation time threshold even though a current flowing through the motor 300 of the deflection unit 113 is within a normal range, the activation time is shortened due to reduction of the lubricant, and the lifetime detection unit 203 determines that it is a timing that replacement is needed.

Figure 7:
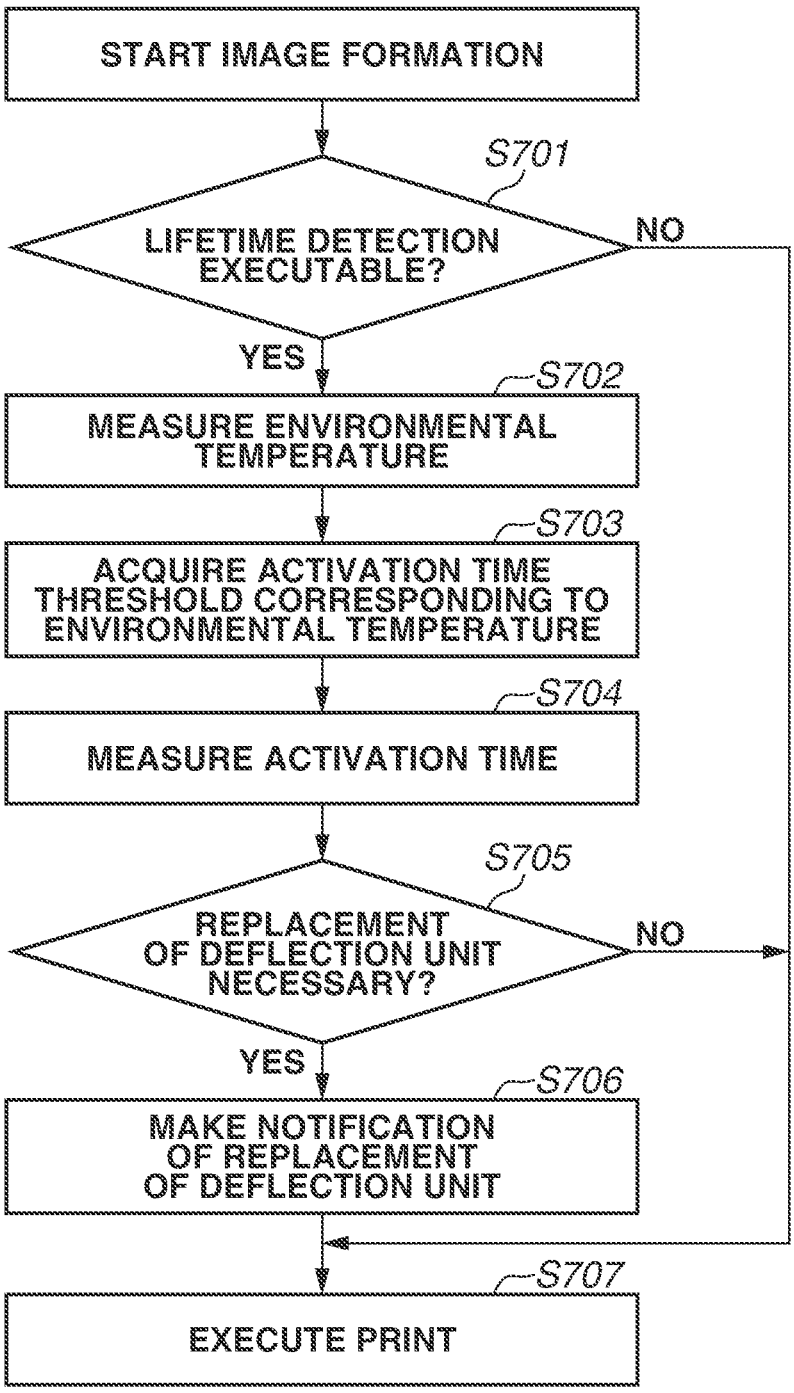
FIG. 7 is a flowchart describing a method of detecting and notifying a lifetime according to the first example embodiment.

A lifetime detection/notification method according to the present example embodiment is now described with reference to FIG. 7. In step S701, when the image forming apparatus 1 starts image formation, the engine controller 200 determines whether lifetime detection is executable. When the image forming apparatus 1 performs print, a temperature of the bearing 35 increases with the operation of the deflection unit 113, and the viscosity of the lubricant filling a shaft support portion changes. When the viscosity of the lubricant changes, the activation time of the deflection unit 113 also changes. For example, when the detection starts in a state where only a short period of time has elapsed since the completion of previous print and the viscosity of the lubricant in the bearing 35 is low, the difference between a temperature of the lubricant and an environmental temperature is large so that there is a possibility of a failure in determining the lifetime detection. To address this, the engine controller 200 checks a condition of the deflection unit 113 in step S701 and determines whether the lifetime detection is executable. The lifetime detection is desirably performed in a condition in which the deflection unit 113 has not operated for an hour to several hours.

In a case where the engine controller 200 determines that the lifetime detection is executable (YES in step S701), the processing proceeds to step S702. In step S702, the temperature detection unit 118 measures an environmental temperature. On the other hand, in a case where the engine controller 200 determines that the lifetime detection is not executable (NO in step S701), the processing proceeds to step S707. In step S707, the image forming apparatus 1 executes print. In step S703, the lifetime detection unit 203 acquires an activation time threshold corresponding to the detected environmental temperature. Further, in step S704, the activation time acquisition unit 202 acquires activation time. In step S705, the lifetime detection unit 203 checks whether the acquired activation time is within the threshold and determines whether the replacement of the deflection unit 113 is necessary. In a case where the lifetime detection unit 203 determines that the replacement of the deflection unit 113 is necessary (YES in step S705), the processing proceeds to step S706. In step S706, the lifetime notification unit 204 notifies a user that it is time for replacing the deflection unit 113 and prompts the user to replace the deflection unit 113.

More specifically, when detecting that the deflection unit 113 has reached its lifetime, the lifetime detection unit 203 transmits a lifetime detection signal to the lifetime notification unit 204 in step S705. A notification method used by the lifetime notification unit 204 can be any one of display on a screen arranged in the image forming apparatus 1, blinking of a notification lamp, transmission of an e-mail to the user's device, transmission of a message, and the like.

The present example embodiment enables provision of the image forming apparatus 1 that makes an appropriate notification of time for replacing the deflection unit 113 or the optical scanning unit 11.

<Deflection Unit Lifetime Detection System with Steady-State Current Value>

Figure 8:
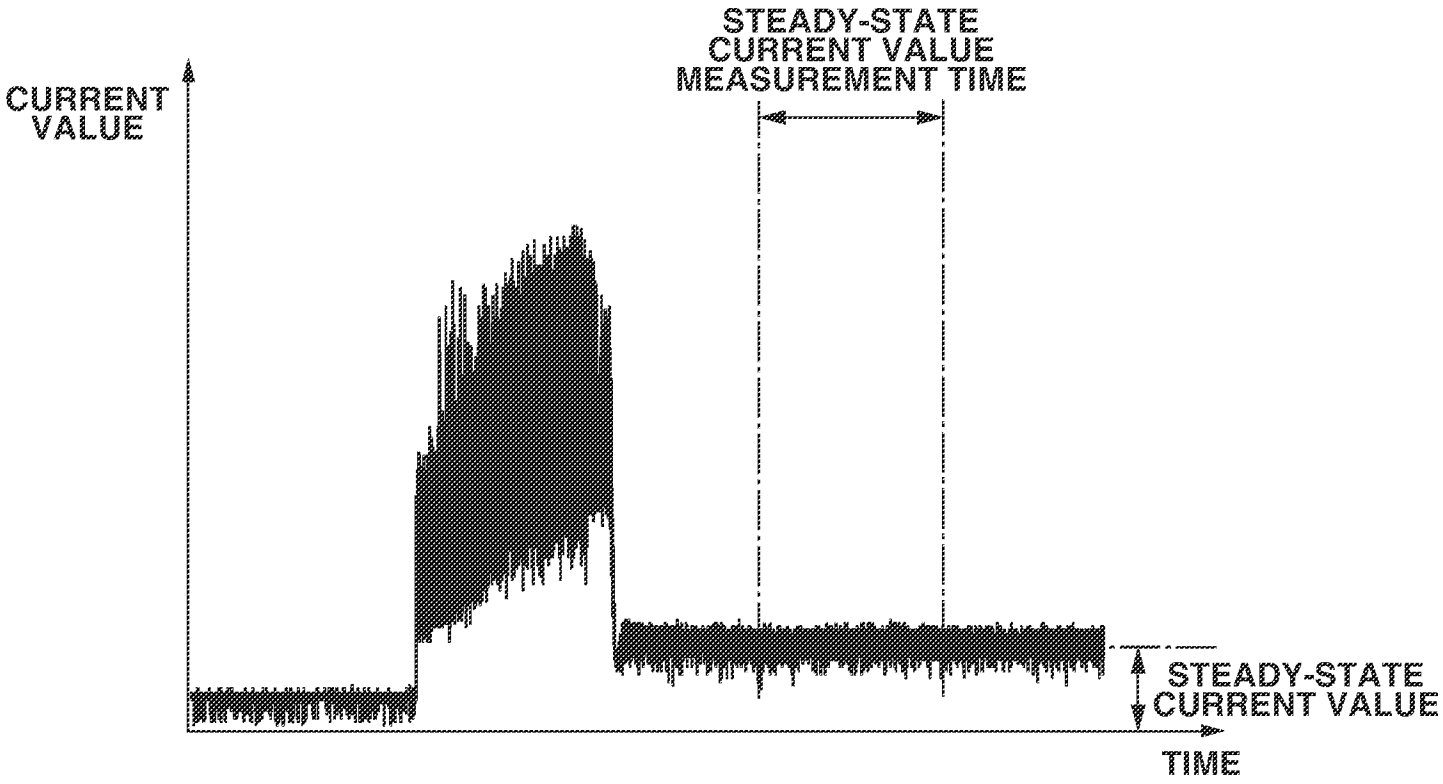
FIG. 8 is a diagram illustrating a change in value of a current flowing through the deflection unit.

A lifetime detection system according to a second example embodiment is now described. The present example embodiment is directed not to a method of using the activation time described in the first example embodiment, but to a method of detecting the lifetime of the deflection unit 113 using a steady-state current value. FIG. 8 is a diagram illustrating a change in value of the current flowing through the deflection unit 113 when the deflection unit 113 is activated. The steady-state current value is a value of the current supplied to the deflection unit 113 when the speed of the deflection unit 113 converges to the rated rotation speed. Assume that an average value of current values in a period of time for measuring the steady-state current value is the steady-state current value.

Figure 9:
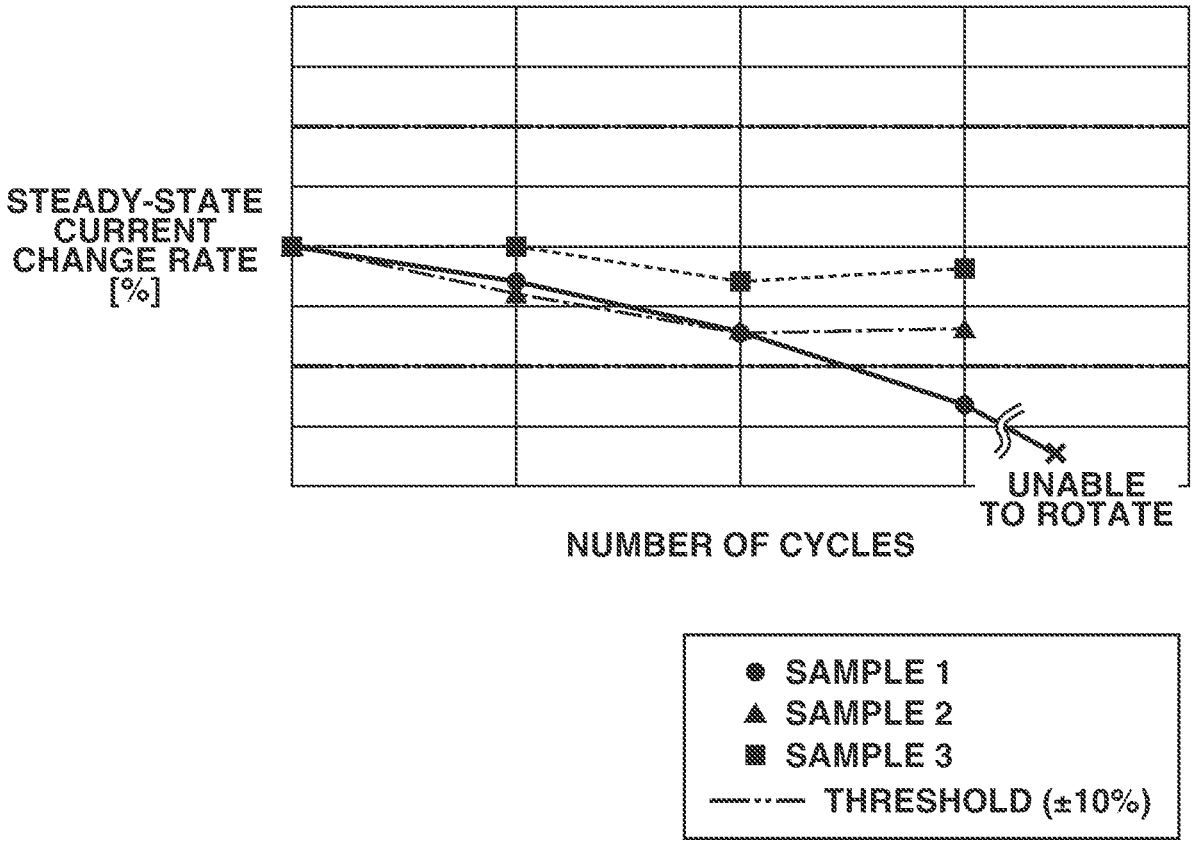
FIG. 9 is a diagram illustrating a transition of a steady-state current change rate.

FIG. 9 is a diagram graphically illustrating the number of cycles of repetition of activation/stop of the deflection unit 113 and a change in the steady-state current value. By repeating the activation/stop of the deflection unit 113, a current value becomes small due to friction of the bearing 35 illustrated in FIG. 2 and reduction of the lubricant in the bearing 35. It is a timing to replace the deflection unit 113 when the change in current value exceeds a predetermined threshold.

Figure 10:
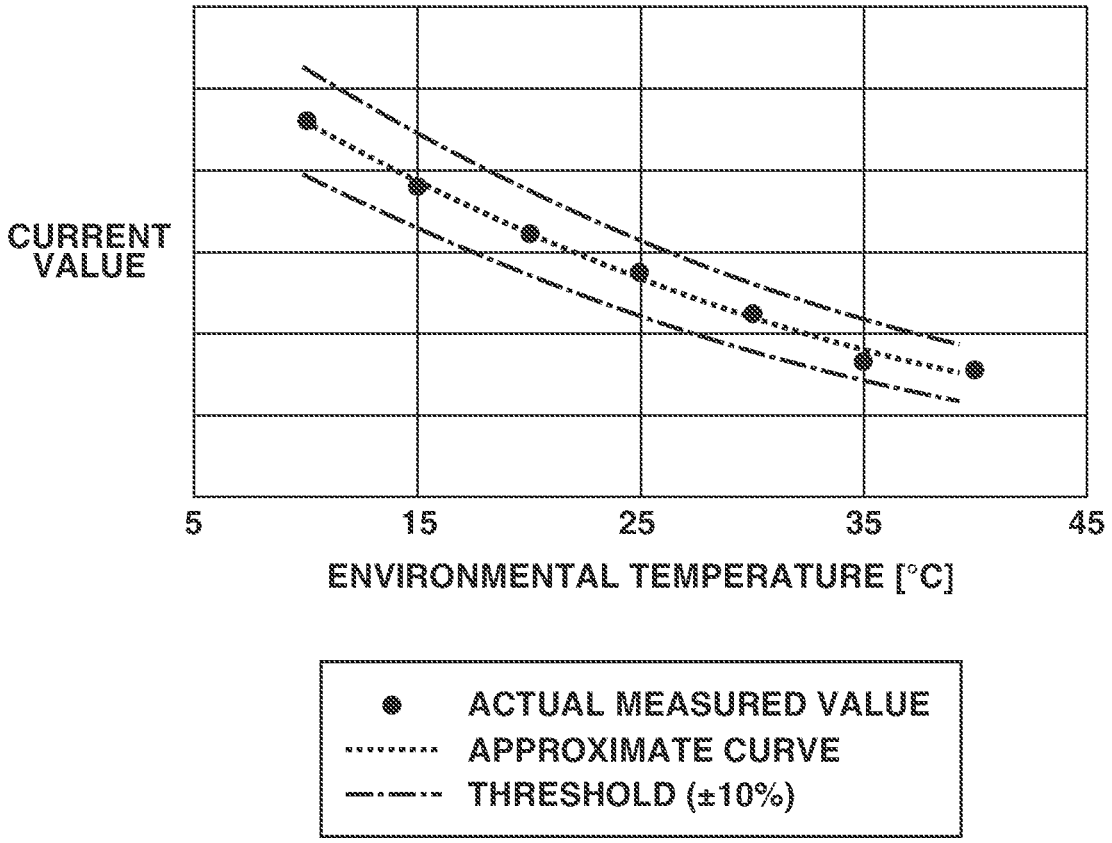
FIG. 10 is a diagram illustrating a change in steady-state current value corresponding to a change in environmental temperature.

FIG. 10 is a diagram illustrating a relationship between a temperature in an installation environment of the deflection unit 113 and the steady-state current value.

In the deflection unit 113, a space between the bearing 35 and the shaft support portion of the rotating shaft 30, which are illustrated in FIG. 2, is filled with the lubricant. Since the viscosity of the lubricant changes depending on a temperature and rotational resistance of the rotating shaft 30 changes, the steady-state current value also changes. As the temperature becomes higher, the viscosity of the lubricant decreases, the rotational resistance becomes lower, and the steady-state current value becomes smaller. For this reason, it is desirable to detect an environmental temperature in a space in which the deflection unit 113 is installed and to set a steady-state current threshold on a temperature-by-temperature basis.

A method of acquiring the steady-state current threshold on the temperature-by-temperature basis is now described. In the step of manufacturing the image forming apparatus 1, a change in steady-state current value with respect to a change in environmental temperature is actually measured in a plurality of deflection units 113, and an approximate expression for a relationship between the environmental temperature and the steady-state current value is obtained. A threshold curve of the threshold (±3 to 15%) is acquired from the approximate expression. For example, in a case of using a quadratic polynomial approximation, the following expressions hold.

$$I=at^2+bt+c \quad \text{(Expression 1)}$$

$$Ic=(1\pm\alpha)I \quad \text{(Expression 2)}$$

In the expressions, I is the steady-state current value, Ic is the steady-state current value threshold, t is the environmental temperature, a, b, and c are coefficients, and α is a threshold coefficient.

In a case where individual differences in steady-state current value of the plurality of deflection units 113 are large, the steady-state current value of each deflection unit 113 is measured in the step of manufacturing the optical scanning unit 11 and a correction value can be added to the threshold curve.

$$I'=I+c' \quad \text{(Expression 3)}$$

In this expression, c' is the correction value.

The steady-state current threshold at each environmental temperature can be obtained from the approximate expression obtained as described above.

In the deflection unit 113 according to the present example embodiment, when the steady-state current value is reduced by 15% or more as compared to that when the deflection unit 113 is new due to reduction of the lubricant, the bearing 35 is abraded by friction between the rotating shaft 30 and the bearing 35, and the abrasion powder is accumulated in the bearing 35. Then the loss of the shaft increases, and eventually, there is an increased risk that the rotating shaft 30 ceases to rotate. For this reason, it is desirable to set the steady-state current value threshold to be smaller by 10 to 20% than the steady-state current value in a case where the deflection unit 113 is new.

Figure 11:
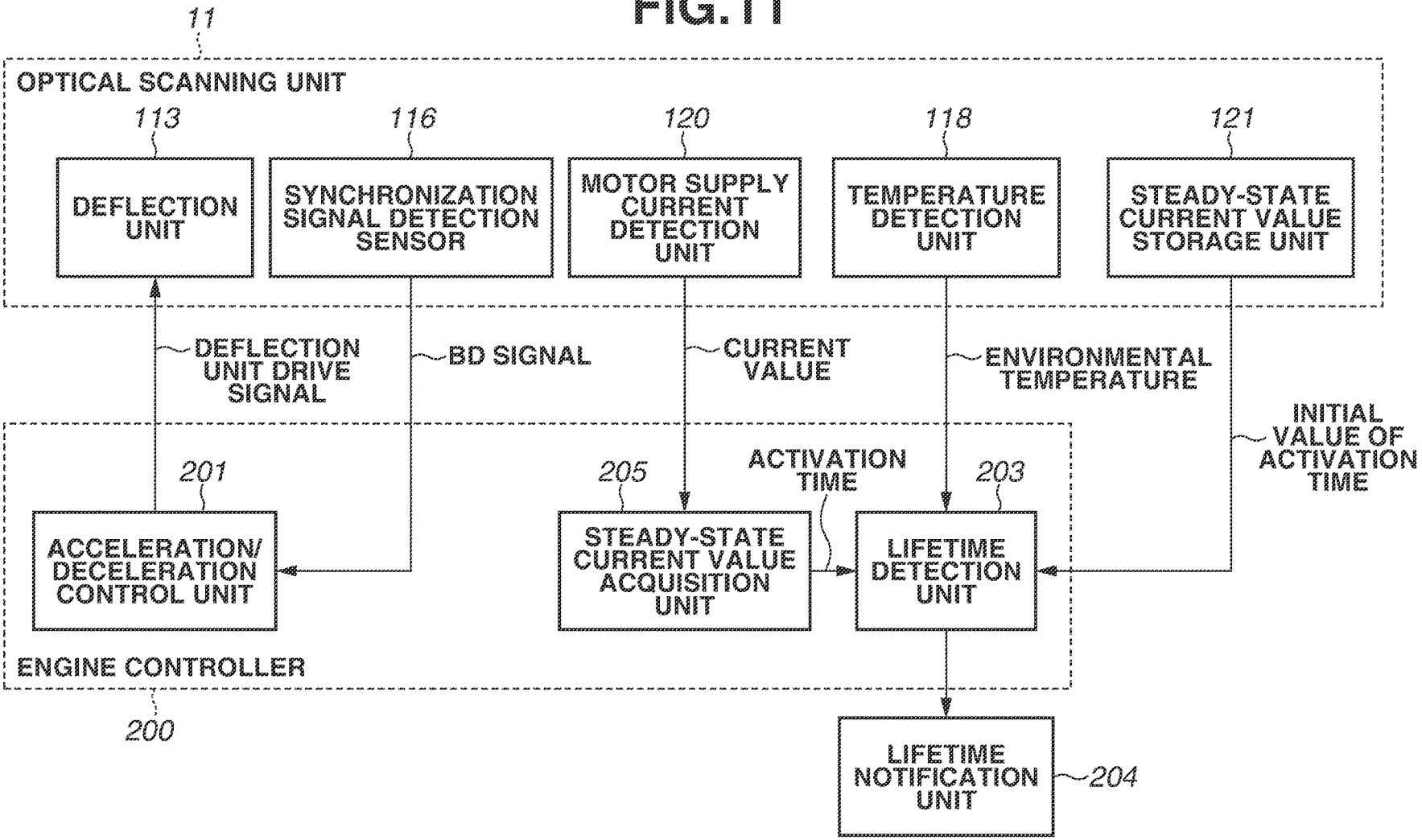
FIG. 11 is a block diagram illustrating a lifetime detection/notification system according to a second example embodiment.

FIG. 11 is a block diagram illustrating the lifetime detection/notification system according to the present example embodiment. The engine controller 200 according to the present example embodiment includes a steady-state current value acquisition unit (current value acquisition unit) 205. The steady-state current value acquisition unit 205 acquires a steady-state current value (current value) using a current value that is detected by a motor supply current detection unit 120 and that is associated with drive of the deflection unit 113.

The optical scanning unit 11 includes a steady-state current value storage unit 121. The steady-state current value storage unit 121 stores the steady-state current value threshold (current value threshold) in the step of manufacturing the optical scanning unit 11.

The optical scanning unit 11 includes the temperature detection unit 118. The temperature detection unit 118 measures an environmental temperature at an installation location. The temperature detection unit 118 is desirably installed near the deflection unit 113, and can be arranged, for example, on the drive substrate 1132.

A relational expression between the steady-state current value threshold and the environmental temperature is programmed into the lifetime detection unit 203, and the lifetime detection unit 203 acquires a threshold at each environmental temperature. The lifetime detection unit 203 detects whether the deflection unit 113 has reached its lifetime using the steady-state current value acquired by the steady-state current value acquisition unit 205, the steady-state current value threshold stored in the steady-state current value storage unit 121 in the step of manufacturing the optical scanning unit 11, and the environmental temperature detected by the temperature detection unit 118. Specifically, the lifetime detection unit 203 acquires a current value threshold using the threshold stored in the steady-state current value storage unit 121 and the environmental temperature detected by the temperature detection unit 118. In a case where the current value acquired by the steady-state current value acquisition unit 205 is lower than the current value threshold, the lifetime detection unit 203 makes a notification of at least one of a lifetime or replacement of the deflection unit 113 or the optical scanning unit 11.

Figure 12:
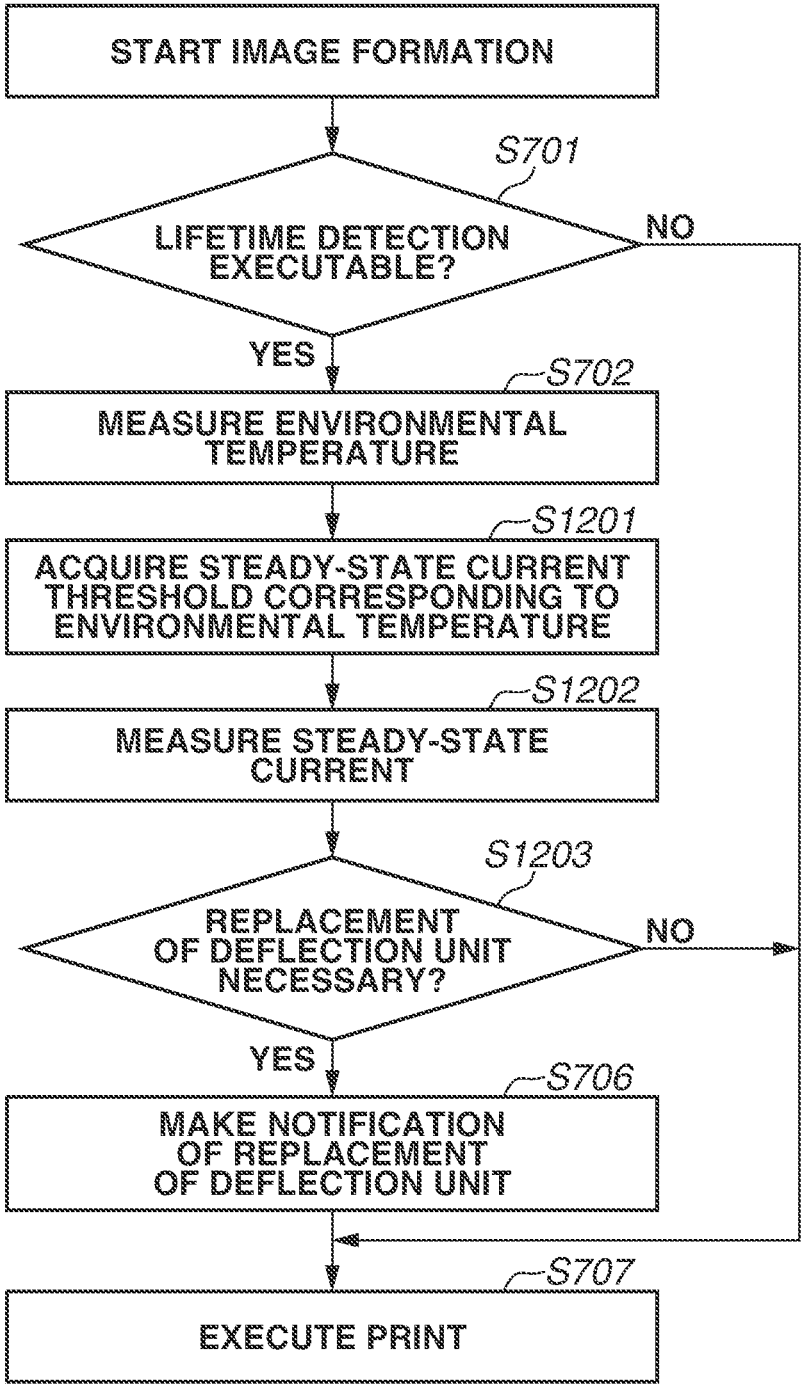
FIG. 12 is a flowchart describing a method of detecting and notifying a lifetime according to the second example embodiment.

A lifetime detection/notification method according to the present example embodiment is now described with reference to FIG. 12. Processing similar to that described in FIG. 7 is denoted by an identical reference number and a detailed description thereof is omitted. First, in step S701, for a reason similar to that in the first example embodiment, the engine controller 200 determines whether lifetime detection is executable. In a case where the engine controller 200 determines that the lifetime detection is executable (YES in step S701), the processing proceeds to step S702. In step S702, the temperature detection unit 118 measures an environmental temperature. In step S1201, the lifetime detection unit 203 acquires a steady-state current value threshold corresponding to the environmental temperature. In step S1202, the lifetime detection unit 203 measures a steady-state current value. In step S1203, the lifetime detection unit 203 checks whether the steady-state current value acquired by the steady-state current value acquisition unit 205 is within the threshold and determines whether the replacement of the deflection unit 113 is necessary. In a case where the lifetime detection unit 203 determines that the replacement is necessary (YES in step S1203), the processing proceeds to step S706. In step S706, the lifetime notification unit 204 notifies the user that it is time for replacing the deflection unit 113 and prompts the user to replace the deflection unit 113.

The present example embodiment enables provision of the image forming apparatus 1 that makes an appropriate notification of time for replacing the deflection unit 113 or the optical scanning unit 11.

While the present disclosure has been described with reference to example embodiments, it is to be understood that the disclosure is not limited to the disclosed example embodiments. The scope of the following claims is to be accorded the broadest interpretation so as to encompass all such modifications and equivalent structures and functions.

This application claims the benefit of Japanese Patent Application No. 2021-030077, filed Feb. 26, 2021, which is hereby incorporated by reference herein in its entirety.

What is claimed is:

1. An image forming apparatus configured to form an image on a recording material, the image forming apparatus comprising:

a photosensitive member;

an optical scanning unit configured to scan the photosensitive member with a laser beam according to image information, the optical scanning unit including:

a deflection unit configured to deflect the laser beam, the deflection unit including a rotating mirror configured to reflect the laser beam and a motor configured to rotate the rotating mirror and having a bearing filled with a lubricant;

a temperature detection unit configured to detect an environmental temperature;

an activation time storage unit configured to store a threshold of activation time of the deflection unit;

an activation time acquisition unit configured to acquire activation time since the deflection unit starts to be activated until speed of the deflection unit reaches rated rotation speed or a predetermined ratio with respect to the rated rotation speed; and a lifetime detection unit configured to detect a lifetime of the deflection unit or the optical scanning unit, wherein the lifetime detection unit acquires an activation time threshold using the threshold stored in the activation time storage unit and the environmental temperature detected by the temperature detection unit and makes a notification of at least one of the lifetime or replacement of the deflection unit or the optical scanning unit in a case where the activation time acquired by the activation time acquisition unit is shorter than the activation time threshold.

2. The image forming apparatus according to claim 1, wherein the temperature detection unit is arranged in the deflection unit.

3. The image forming apparatus according to claim 1, wherein the activation time threshold is shorter by 10 to 20% than the activation time in a case where the deflection unit is new.

4. An image forming apparatus configured to form an image on a recording material, the image forming apparatus comprising:

a photosensitive member;

an optical scanning unit configured to scan the photosensitive member with a laser beam according to image information, the optical scanning unit including:

a deflection unit configured to deflect the laser beam, the deflection unit including a rotating mirror configured to reflect the laser beam and a motor configured to rotate the rotating mirror and having a bearing filled with a lubricant;

a temperature detection unit configured to detect an environmental temperature;

a current value storage unit configured to store a threshold of current flowing through the deflection unit;

a current value acquisition unit configured to acquire a value of current supplied to the deflection unit; and a lifetime detection unit configured to detect a lifetime of the deflection unit or the optical scanning unit, wherein the lifetime detection unit acquires a current value threshold using the threshold stored in the current value storage unit and the environmental temperature detected by the temperature detection unit and makes a notification of at least one of the lifetime or replacement of the deflection unit or the optical scanning unit in a case where the value of the current acquired by the current value acquisition unit is lower than the current value threshold.

5. The image forming apparatus according to claim 4, wherein the temperature detection unit is arranged in the deflection unit.

6. The image forming apparatus according to claim 4, wherein the current value threshold is lower by 10 to 20% than the value of the current in a case where the deflection unit is new.

7. An image forming apparatus configured to form an image on a recording material, the image forming apparatus comprising:

a photosensitive member;

an optical scanning unit configured to scan the photosensitive member with a laser beam according to image information, the optical scanning unit including:

a deflection unit configured to deflect the laser beam, the deflection unit including a rotating mirror configured to reflect the laser beam and a motor configured to rotate the rotating mirror and having a bearing filled with a lubricant;

a temperature detection sensor configured to detect an environmental temperature;

an activation time storage memory configured to store a threshold of activation time of the deflection unit;

an activation time calculator configured to calculate activation time since the deflection unit starts to be activated until speed of the deflection unit reaches rated rotation speed or a predetermined ratio with respect to the rated rotation speed; and a lifetime detector configured to detect a lifetime of the deflection unit or the optical scanning unit, wherein the lifetime detector acquires an activation time threshold using the threshold stored in the activation time storage memory and the environmental temperature detected by the temperature detection sensor and makes a notification of at least one of the lifetime or replacement of the deflection unit or the optical scanning unit in a case where the activation time acquired by the activation time calculator is shorter than the activation time threshold.

8. The image forming apparatus according to claim 7, wherein the temperature detection sensor is arranged in the deflection unit.

9. The image forming apparatus according to claim 7, wherein the activation time threshold is shorter by 10 to 20% than the activation time in a case where the deflection unit is new.

10. An image forming apparatus configured to form an image on a recording material, the image forming apparatus comprising:

a photosensitive member;

an optical scanning unit configured to scan the photosensitive member with a laser beam according to image information, the optical scanning unit including:

a deflection unit configured to deflect the laser beam, the deflection unit including a rotating mirror configured to reflect the laser beam and a motor configured to rotate the rotating mirror and having a bearing filled with a lubricant;

a temperature detection sensor configured to detect an environmental temperature;

a current value storage memory configured to store a threshold of current flowing through the deflection unit;

a current value calculator configured to calculate a value of current supplied to the deflection unit; and a lifetime detector configured to detect a lifetime of the deflection unit or the optical scanning unit, wherein the lifetime detector acquires a current value threshold using the threshold stored in the current value storage memory and the environmental temperature detected by the temperature detection sensor and makes a notification of at least one of the lifetime or replacement of the deflection unit or the optical scanning unit in a case where the value of the current acquired by the current value calculator is lower than the current value threshold.

11. The image forming apparatus according to claim 10, wherein the temperature detection sensor is arranged in the deflection unit.

12. The image forming apparatus according to claim 10, wherein the current value threshold is lower by 10 to 20% than the value of the current in a case where the deflection unit is new.

* * * * *